United States Patent [19]

Manson

[11] 4,018,488

[45] Apr. 19, 1977

[54] SLIDE BRACKETS

[75] Inventor: Morris Manson, Great Neck, N.Y.

[73] Assignee: Corax Corporation, Yonkers, N.Y.

[22] Filed: Nov. 17, 1975

[21] Appl. No.: 632,303

[52] U.S. Cl. ..... 312/348; 312/341 R; 312/343; 308/3.8; 248/429

[51] Int. Cl.[2] ..... A47B 88/00; F16C 21/00

[58] Field of Search ..... 312/348, 341, 343, 334; 248/393, 429, 430; 308/3.6, 3.8

[56] References Cited

UNITED STATES PATENTS

| | | | |
|---|---|---|---|
| 2,014,553 | 9/1935 | Browne | 248/430 |
| 2,307,305 | 1/1943 | Saunders et al. | 308/3.8 |
| 2,534,350 | 12/1950 | Gussack | 312/343 |
| 2,865,684 | 12/1958 | Meyer et al. | 312/348 |
| 3,215,475 | 11/1965 | Manson | 308/3.6 |
| 3,278,250 | 10/1966 | Vogt | 312/348 |
| 3,901,564 | 8/1975 | Armstrong | 308/3.8 |
| R25,428 | 7/1963 | Manson | 312/343 |

FOREIGN PATENTS OR APPLICATIONS

| | | | |
|---|---|---|---|
| 1,457,675 | 9/1966 | France | 308/3.8 |

*Primary Examiner*—Robert L. Wolfe
*Assistant Examiner*—Victor N. Sakran
*Attorney, Agent, or Firm*—Posnack, Roberts & Cohen

[57] ABSTRACT

A slide bracket for a drawer assembly or the like, comprising first and second elongated members mounted for relative longitudinal sliding movement, the members including respective opposed side walls shaped to define longitudinal ball bearing tracks. Ball bearings are supported by a carrier and mounted in the tracks to facilitate the relative longitudinal sliding movement of the elongated members. The elongated members are formed with longitudinal grooves extending the lengths thereof to confer lateral deflectability for the side walls of the tracks in order to minimize retarding pressure of the walls with the ball bearings and noise resulting therefrom. The spacing between the side walls of the ball bearing tracks is gradually reduced in an end section of the track whereat the elongated members approach the position of maximum relative longitudinal extension.

3 Claims, 4 Drawing Figures

SLIDE BRACKETS

CROSS-RELATED APPLICATION

This application is related in subject matter to U.S. Pat. No. Re 25,428, the contents of which are incorporated by reference herein.

FIELD OF THE INVENTION

The invention relates to slide brackets of the type for slidably supporting and guiding pull-out drawers or the like.

BACKGROUND

In U.S. Pat. No. Re 25,482, I have disclosed a slide bracket construction adapted for slidably supporting and guiding pull-out drawers. Such construction has been found highly effective and satisfies all of the objectives as noted in said patent. However, it has been found that in use, the slide bracket develops noise and in order to eliminate this, it is necessary to lubricate the walls of the slide track.

The use of such lubricant is undesirable and results in unnecessary added cost to the construction and additional maintenance. It is a necessary condition, however, to maintain the operation of the slide bracket noise-free.

SUMMARY OF THE INVENTION

An object of the invention is to provide a slide bracket construction of the type as noted hereinabove and as shown in U.S. Pat. No. Re 25,428, but which avoids the problem of noise and eliminates the need for use of lubricant.

It has been unexpectedly discovered that by the provision of a simple mechanical expedient, the problem of noise in the slide bracket construction can be overcome.

In a surprising way, it has been found that by the judicious provision of longitudinal grooves in the elongated members of the brackets, the aforesaid problem of noise is overcome without the use of lubricant.

More specifically, it has been found that by the provision of a longitudinal hinge action for the elongated members, lateral deflectability can be imparted to the side walls of the tracks, thereby minimizing retarding pressure of the walls with the ball bearings and obviating the noise which results from such pressure.

It is believed that the noise which is generated in unlubricated conventional elongated sliding members of the slide bracket arises from minor differences in width of the ball bearing tracks due to tolerance differences in manufacture. The deflectability of the side walls afforded by the longitudinal hinge action of the invention apparently compensates for any tolerance differences and allows operation of the slide members without intervening noise. Although, the precise reasons why the noise is eliminated may not be fully understood, and I do not deem myself to be bound by any particular theory, it is nevertheless readily observable in practice that the formation of the grooves eliminates the noise.

A further object of the invention is to override the longitudinal hinge action in an end braking section when the members approach a position of maximum relative longitudinal displacement and to oppose separation of the slide members without the need for the conventional positive stop means of the prior art.

This is achieved by gradually reducing the width of the ball bearing tracks in such end braking section.

As a consequence of such gradual overriding of the longitudinal hinge action, a gradual and increasing braking action takes place avoiding the need for a conventional stop to prevent separation of the slide members.

Moreover, due to the absence of a positive stop, it becomes possible to separate the slide members by application of a sudden impulse force or snap force on the drawer slide. This obviates the need for complex operations of removing the stop in conventional constructions when the drawer is to be removed.

In operation, the user feels a gradual resistance to the relative movement of the slide members in the end braking section without any sudden impact or abrupt braking forces as caused by the conventional stop. This gives ample warning to the user that the slide members are approaching their maximum position of relative longitudinal movement.

The invention will be described in detail hereafter with reference to one embodiment given by way of example only.

DETAILED DESCRIPTION

Figure 1:
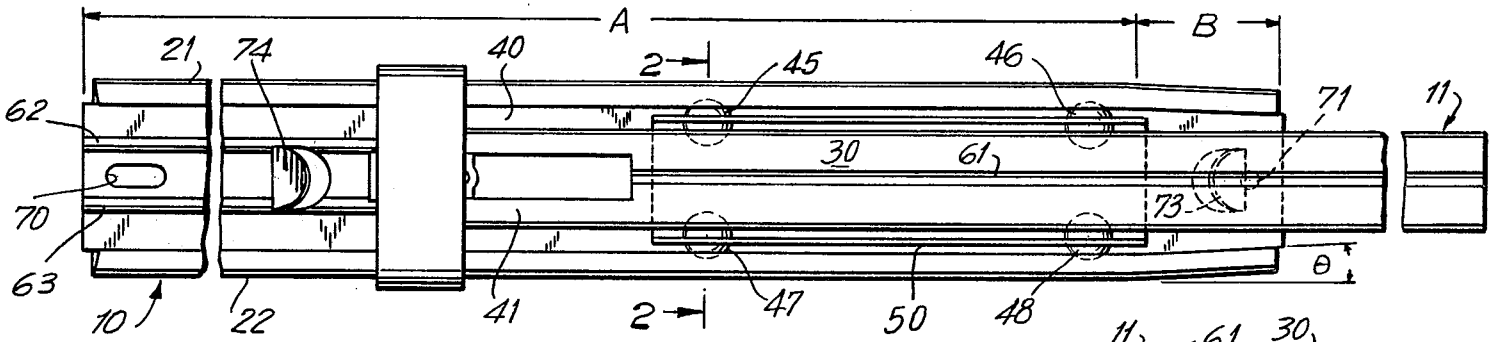
FIG. 1 is a plan view, broken in length for convenience, of the slide bracket of the invention.

Referring to the drawing, therein is seen first and second elongated members 10 and 11 mounted for relative longitudinal sliding movement. These members are adapted for being attached to a housing and a drawer respectively to allow such drawer to be displaced relative to the housing. The details of attachment of the slide members is shown in U.S. Pat. No. Re 25,428 and is not reproduced herein since the invention is not directed to such construction, but rather to the details of construction of the slide members themselves.

The slide member 10 has a base 20 and upstanding walls 21 and 22. The slide member 11 has a base 30 and upstanding walls 31 and 32.

Figure 2:
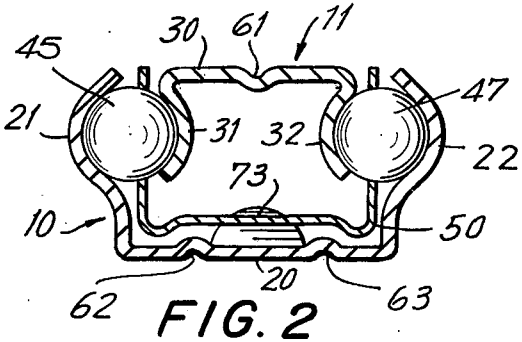
FIG. 2 is a sectional view taken along line 2—2 in FIG. 1.

The walls 21, 31 and 22, 32 face one another and are respectively formed of part circular shape so as to define longitudinal ball bearing tracks 40 and 41. The tracks 40 and 41 define a circular section as seen in FIG. 2 and ball bearings 45, 46, 47 and 48 are disposed in the ball bearing tracks to facilitate the relative longitudinal sliding movement of the members 10 and 11. The ball bearings are mounted on a carrier 50 which is freely displaceable between the members 10 and 11 as evident from FIGS. 1 and 2.

Generally, slide member 10 is secured to the fixed housing and member 11 to the slidable drawer. In operation, member 11 is longitudinally displaced relative to member 10 by sliding movement thereof as promoted by the provision of the ball bearings mounted on carrier 50.

Up to this point, the construction which has been described is conventional. With such conventional construction, it has been found necessary to lubricate the longitudinal ball bearing tracks in order to prevent the generation of noise in the course of relative movement of members 10 and 11.

The invention is predicated upon the surprising discovery that the elimination of the noise can be effected without need for application of lubricant and solely by means of a relatively simple mechanical expedient.

Namely, according to the invention, the slide member 11 is provided with a longitudinal groove 61 extending the length thereof and the slide member 10 is provided with two longitudinal grooves 62 and 63 extending the length thereof. These longitudinal grooves 61, 62 and 63 provide longitudinal hinge action which allows lateral deflectability of the side walls of the respective slide member. Such lateral deflectability obviates the production of retarding pressure of the side walls of the track with the ball bearings and this eliminates the production of noise during longitudinal relative sliding movement of the slide members. The degree of lateral deflectability is relatively slight and it is sufficient for the provision of relatively shallow grooves in the base of the members as shown.

Figure 3A:
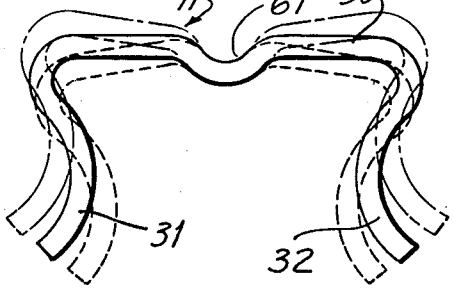
FIG. 3*a* is a diagrammatic cross-sectional illustration of one of the slide members showing the deflection pattern thereof.
Figure 3B:
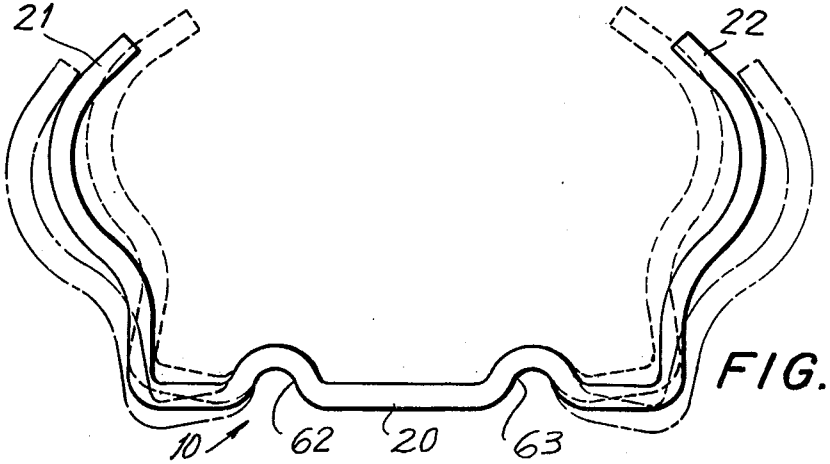
FIG. 3*b* is a similar diagrammatical cross-section of the other slide member showing its deflection pattern.

FIGS. 3*a* and 3*b* show in exaggerated fashion the deflection of the side walls which can be obtained by virtue of the provision of the longitudinal grooves in the bases of the respective members. Such longitudinal grooves serve as longitudinal hinges to provide a small amount of angular deflection of the portions of the members on opposite sides of the groove.

In the illustrated embodiments, the longitudinal hinge has been formed by dimpling the base of the respective slide members to form the groove or depression. In this way, there is no loss of material from the slide members. Alternatively, the grooves can be machined in the bases of the slide members to provide the hinge action.

The movable slide member 11 has the groove thereof formed in the center of the base and the wider stationary member 10 has two grooves formed therein on opposite sides of the longitudinal centerline thereof. The attachment of the member 10 to the stationary structure is effected by mounting screws in holes 70 and 71 at opposite ends of the member 10 disposed along the longitudinal axis thereof.

Front and rear tab members 73 and 74 are bent up from the stationary member 10 to limit the movement of the carrier member 50 between limit positions. However, the slide member 11 can still slide relative to the carrier member 50 and fixed member 10.

It has been found that extension of the slide member 11 to an outermost limit position, i.e., corresponding to an open position of the drawer, can be effected by a construction according to the invention without the need for positive stops which prevent removal of slide member 11 as in conventional constructions. Moreover, such positive stops produce an abrupt stoppage when the slide member reaches its outermost position. The user is not forewarned of this maximum open position and the sudden impact and abrupt stoppage can be disadvantageous in the case when delicate articles are carried in the drawer. Furthermore, in order to make the drawer removable, the stops must be demountable, and this poses difficulty due to the inaccessability of the space in question between the slide members.

The invention overcomes these disadvantages by the provision of a first main section A in which unrestrained longitudinal movement is permitted between the sliding members, and a second end braking section B in which a gradual braking action is exerted on the movable slide member 11 and a stop position is established without the use of restraining stop members.

During ordinary opening of the drawer, when carrier 50 reaches the end braking section B, the longitudinal hinge action is overridden and the member 11 is gradually and securely braked as the carrier reaches the end stop 73.

The gradual braking of the longitudinal movement of member 11 in end section B is obtained by reducing the spacing between the side walls of the ball bearing tracks and specifically by tapering the side walls 21 and 22 of the stationary member 10 in the braking section B. In FIG. 1, it can be seen that the side walls 21, 22 are inclined at an angle to achieve the braking action as described above. This angle is of the order of, but a few degrees to achieve the desired effect. Although the hinge action of the grooves is overcome by the taper of the outer side walls of the ball bearings, it is a surprising finding that the existence of the longitudinal hinge along the entire length of the sliding members precludes any generation of noise even in the braking section B.

As a consequence of the elimination of any positive stop members directly between slide members 10 and 11, a great advantage is obtained in that the slide member 11 can be removed from member 10 by application of a sudden impulse or snap force on the drawer. Thereby the drawer can be separated from the fixed structure. Replacement is simply effected by reinserting slide member 11 into carrier 50 held in member 10 by tab 73 and applying an impulse or snap force to cause the slide member to operatively re-engage in the carrier and re-assume the position shown in FIG. 1.

It has also been found that the longitudinal location of tab 74 in member 10 is of significance in relation to the length of member 11. In particular, when carrier 50 is in its most rearward position, the drawer will be in its most rearward position and hence the member 11 will be in its position of greatest insertion in member 10. This position of greatest insertion can be adjusted by forcing member 11 axially in the carrier, either inwardly or outwardly. The forward end of the carrier will be spaced from section B at this time so that when the drawer is subsequently pulled out there will be free movement thereof with no braking action. This is in contrast to the position of tab 73 which engages the forward end of the carrier when the carrier is at the end of braking section B.

Although the invention has been described with reference to a specific embodiment thereof, numerous modifications and variations will become evident to those skilled in the art without departing from the scope and spirit of the invention as defined in the attached claims.

What is claimed is:

1. A slide bracket comprising first and second elongated members mounted for relative longitudinal sliding movement, said members including respective opposed side walls shaped to define longitudinal ball bearing tracks, ball bearings mounted in said tracks for facilitating the relative longitudinal sliding movement of said members, groove means in at least one of said members spaced from said tracks for providing longitudinal hinge action for said members to confer lateral deflectability for said side walls of said tracks to minimize retarding pressure of said walls with the ball bearings and noise resulting therefrom, said members having relative longitudinal movement in a first main section and in a second end braking section, said track extending continuously along said first and second sections, and means in said end braking section for gradually overriding said longitudinal hinge action in said end braking section as said members approach a position of maximum relative longitudinal extension, said means for overriding the longitudinal hinge action being constituted by a reduced spacing between the side walls of the ball bearing tracks, said reduced spacing between the side walls of the ball bearing tracks being obtained by a narrowing taper between the side walls of the outer member in said end braking section.

2. A slide bracket as claimed in claim 1 wherein each member includes a base from which said side walls extend, said groove means extending centrally in the base of one member, and on opposite sides of the center of the other member.

3. A slide bracket as claimed in claim 1 comprising a carrier for said ball bearings disposed between said members for relative longitudinal movement, first and second tabs upfolded in said outer member to engage said carrier to limit movement thereof between end positions respectively corresponding to retracted and extended positions of the sliding members, said tabs being positioned in said outer member such that the carrier is outside the braking section in retracted position and in the braking section in extended position.

* * * * *